US006730645B1

(12) United States Patent
Foley et al.

(10) Patent No.: US 6,730,645 B1
(45) Date of Patent: May 4, 2004

(54) METHOD FOR IMPROVING DYE STABILITY IN COLORED ACIDIC RINSE-AID FORMULATIONS

(75) Inventors: Peter Robert Foley, Cincinnati, OH (US); Xiaoqing Song, West Chester, OH (US); Lucio Pieroni, Hyogo (JP)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/889,054

(22) PCT Filed: Jan. 20, 2000

(86) PCT No.: PCT/US00/01383

§ 371 (c)(1),
(2), (4) Date: Jul. 11, 2001

(87) PCT Pub. No.: WO00/43486

PCT Pub. Date: Jul. 27, 2000

Related U.S. Application Data

(60) Provisional application No. 60/116,871, filed on Jan. 22, 1999.

(51) Int. Cl.[7] ..... C11D 3/40; C11D 3/37

(52) U.S. Cl. ..... 510/220; 510/223; 510/227; 510/229; 510/230; 510/514; 510/521

(58) Field of Search ..... 510/220, 223, 510/227, 229, 230, 514, 521

(56) References Cited

U.S. PATENT DOCUMENTS 5,358,653 A * 10/1994 Gladfelter et al. ..... 252/90
6,257,253 B1 * 7/2001 Lentsch et al. ..... 134/25.2

FOREIGN PATENT DOCUMENTS

| | | |
|---|---|---|
| DE | 43 16 744 A1 | 11/1994 |
| EP | 0 308 221 A1 | 3/1989 |
| EP | 0 659 873 A1 | 6/1995 |
| WO | WO 95/19414 | 7/1995 |

* cited by examiner

*Primary Examiner*—Charles Boyer
(74) *Attorney, Agent, or Firm*—Pankaj M. Khosla; Kevin L. Waugh

(57) ABSTRACT

A method for improving stability of a dye used in a colored aqueous acidic rinse aid composition to ambient and ultra-violet light radiation is disclosed. The method includes the step of adding a chelant to an acidic rinse aid composition. The chelant is present in an amount of at least 1 ppm by weight of the rinse aid composition.

15 Claims, No Drawings

METHOD FOR IMPROVING DYE STABILITY IN COLORED ACIDIC RINSE-AID FORMULATIONS

This application claims the benefit of Provisional application Ser. No. 60/116,871, filed Jan. 22, 1999.

TECHNICAL FIELD

The present invention relates to acidic rinse aid formulations used in automatic dishwashing. More particularly, the invention relates to a method for improving stability of a dye used in a colored aqueous acidic rinse aid composition to ambient and ultra-violet light radiation of a machine dishwasher rinse aid formulation.

BACKGROUND OF THE INVENTION

The use of rinse aids in commercial and institutional machine dishwashers and also in household automatic dishwashers, is well known. In automatic dishwashing, during the rinse cycle, a final rinse of fresh water serves to displace pre-final rinse water and its attendant detergent and soil residues. Rinse aid formulations are aqueous solutions containing a low foam nonionic surfactant. During the rinse cycle, the rinse aid is injected into the final fresh water rinse at a concentration of about 100 to about 500 ppm. The surfactant in the rinse water lowers the surface tension of the rinse water and improves the wetting action of the rinse water.

The inventors of the present invention have previously discovered that it is possible to formulate an aqueous rinse aid containing a low foam nonionic surfactant and a low molecular weight neutralized, partially neutralized, or non-neutralized polyacrylate polymer without the use of a compatibilizing high molecular weight polymer or a high cloud point co-surfactant, thus providing an acidic, stable aqueous rinse aid dispersion which reduces spotting and filming while improving sheeting action and drainage.

One major problem, however, associated with acidic, stable rinse aid dispersions is that when a dye is added in the composition to impart a pleasing color, especially a typical blue or green dye, such as a FD&C #1 Blue dye for example, there is a tendency for such rinse aid compositions to change color upon exposure to ambient and UV light, for example sunlight. Frequently, if not inevitably, acidic rinse aid products will be subjected to UV light (e.g., sunlight) repeatedly and over extended periods of time prior to use by the consumer. The formulations of typical automatic dishwashing (ADW) rinse aid products are specifically tailored to a color that has been proven to be aesthetically pleasing to consumers. Any change in the target formulation color, especially when clear or translucent bottle or other packaging container is used, can negatively impact the consumer's perception of the quality of the product.

Typically, in the past, colored rinse aid compositions have been formulated at or near neutral pH, since it has been generally heretofore understood that non-acidic rinse aid compositions will not reduce the dye stability to ambient and ultraviolet light radiation. The inventors of the present invention have addressed this dye stability issue in the present invention and provided an effective solution to this problem. Before the present invention, there has been no method or composition known heretofore that addresses this dye stability problem in acidic rinse aid compositions.

Accordingly, it has thus been desirable to have a colored acidic rinse aid product which is not significantly altered by UV light. Further, despite the above-mentioned disclosures in the art, it has been desirable to have an acidic rinse aid product which has superior performance in addition to a packaging appearance. It is extremely desirable that the packaging appearance (e.g., color) is maintained until the consumer has disposed of the product. The present invention overcomes the problems as set forth above.

BACKGROUND ART

U.S. Pat. No. 5,254,282, issued on Oct. 19, 1993 to Fusiak, discloses acidified paint removal formulations which are stabilized against color formation by inclusion of a chelating agent; and U.S. Pat. No. 5,206,006, issued on Apr. 27, 1993 to Frontini et al. discloses a composition of the trinder type for detecting hydrogen peroxide evolved in a solution, which contains a chelating agent, relevant portions of both of these patents being incorporated herein by reference.

SUMMARY OF THE INVENTION

The invention meets the needs above by providing a method and composition for improving stability of a dye used in a colored aqueous acidic rinse aid composition to ambient and ultra-violet light radiation.

In one aspect of the present invention, the method for improving stability of a dye used in a colored aqueous acidic rinse aid composition to ambient and ultra-violet light radiation includes the step of adding a chelant to an acidic rinse aid composition. The chelant is present in an amount of at least 1 ppm by weight of the rinse aid composition.

In another aspect of the present invention, a colored acidic rinse aid composition exhibiting improved stability of a dye used therein to ambient and ultra-violet light radiation includes a low foaming nonionic surfactant present in a range of from about 2% to about 80% by weight of the rinse aid composition. The composition also includes a hydrotrope present in a range of from about 0.5% to about 20% by weight of the rinse aid composition. The composition further includes a polyacrylate polymer present in a range of from about 0.1% to about 15% by weight of the rinse aid composition. The polymer has a weight average molecular weight in a range of from about 1000 to about 50,000. The composition still further includes a chelant. The chelant is present in an amount of at least 1 ppm by weight of the rinse aid composition.

DETAILED DESCRIPTION OF THE INVENTION

In the preferred embodiment of the present invention, the method includes the step of adding a chelant to an acidic rinse aid composition. The chelant is desirably present in an amount of at least 1 ppm, preferably at least 50 ppm, more preferably at least 100 ppm and most preferably at least 150 ppm by weight of the rinse aid composition.

Chelants

In the preferred embodiment, the acidic rinse aid composition includes chelants selected from the group consisting of amino carboxylates, amino phosphonates, polyfunctionally-substituted aromatic chelants, and mixtures thereof. Other useful chelants include iron and/or manganese chelants. Amino carboxylates useful as optional chelants include ethylenediaminetetracetates, N-hydroxyethylethylenediaminetriacetates, nitrilotriacetates, ethylenediamine tetraproprionates, triethylenetetra-amine-hexacetates, diethylenetriaminepentaacetates, and ethanoldiglycines, alkali metal, ammonium, and substituted ammonium salts therein and mixtures therein.

Polyfunctionally-substituted aromatic chelants include dihydroxydisulfobenzenes such as 1,2-dihydroxy-3,5-disulfobenzene, and ethylenediamine disuccinate ("EDDS").

In the preferred embodiment, the chelant is selected from the group consisting of ethylene diamine tetra acetic acid carboxylate, diethylene triamine penta acetic acid carboxylate, and mixtures thereof. In another preferred embodiment, the chelants are selected from polyphosphonate, ethylene diamine tetra acetic acid carboxylate (EDTA) and diethylene triamine penta acetic acid carboxylate (DTPA). Most preferably, the chelant is ethylene triamine penta phosphoric acid.

Dyes

In the preferred embodiment of the present invention, the dye is selected from the group consisting of Pontamine Blue (Copper Phthalocyanine Dyestuff), and Liquitant Patent Blue (polymeric colorant) and FD&C Blue #1 (having the molecular formula $C_{37}H_{34}N_2Na_2O_9S_3$), and mixtures thereof. Preferably, the dye has a color selected from the group consisting of blue, green, or mixtures thereof. It has been found that the blue and green dyes typically used in rinse aid formulations, such as the FD&C #1, are unstable to UV light in acidic conditions unless the rinse aid composition is formulated with a chelant according to the present invention. It has been found that even the so-called "acid stable" dyes, such as Acid Blue 80, fade quickly when used in acidic rinse aids, i.e., the dye is colorless after an exposure of 1 to 2 days under UV light radiation, unless the rinse aid is formulated according to the present invention, with a chelant. Desirably, the dyes are added in an amount in a range of from about 0.25% of a 1% solution in water to about 0.5% of a 1% solution in water.

Dye-Chelant Systems

In the preferred embodiment the dye is selected from the group consisting of copper phthalocyanine dyestuff, FD&C #1 colors, polymeric colorants, and mixtures thereof, and the chelant is selected from the group consisting of amino carboxylates, amino phosphonates, polyfunctionally-substituted aromatic chelants, and mixtures thereof. It has been found that these "dye-chelant" systems, optimally yield the most effective dye color stability to ambient and UV light radiation, when such dyes are used in acidic rinse aids.

The most preferred chelants are selected from polyphosphonate ethylene diamine tetra acetic acid carboxylate (EDTA) and diethylene triamine penta acetic acid carboxylate (DTPA) in combination with the most preferred dyes selected from blue dyes such as Pontamine Blue (Copper Phthalocyanine Dyestuff), and Liquitant Patent Blue (polymeric colorant) and FD&C Blue #1 (for example, an FD&C Blue #1 having the molecular formula $C_{37}H_{34}N_2Na_2O_9S_3$). These dye-chelant systems discovered by the inventors, when formulated in an acidic rinse aid dispersion, all form ambient and UV light resistant, color stable systems.

The especially preferred Dye-Chelant systems discovered by the inventors are listed below:

Liquitant Patent Blue in combination with CW-Base;
FD&C #1 in combination with CW-Base;
Pontamine Blue in combination with CW-Base;
Liquitant Patent Blue in combination with DTPA;
FD&C #1 in combination with DTPA; and
Liquitant Patent Blue in combination with DTPA.

Carboxylic acids

In the preferred embodiment, the dye stability is further enhanced in the presence of carboxylic acids. Especially preferred are polycarboxylic acids, such as Sokolan PA13PN manufactured by BASF, Acusol 480, and Acusol 480N, both manufactured by Rohm & Haas. These polycarboxylic acids provide multiple benefits, as they help stabilize the dye and deliver filming performance benefits in the rinse cycle of automatic dishwashing. Desirably, the polycarboxylic acid is present in an amount in a range of from about 0.25% to about 10% by weight of the acidic rinse aid composition, and preferably, in an amount in a range of from about 1% to about 6% by weight.

In another embodiment of the present invention, the colored acidic rinse aid composition exhibiting improved stability of a dye used therein to ambient and ultra-violet light radiation includes a low foaming nonionic surfactant desirably present in a range of from about 2% to about 80% by weight of the rinse aid composition. The composition also includes a hydrotrope desirably present in a range of from about 0.5% to about 20% by weight of the rinse aid composition. The composition further includes a polyacrylate polymer desirably present in a range of from about 0.1% to about 15% by weight of the rinse aid composition. The polymer has a weight average molecular weight in a range of from about 1000 to about 50,000. The composition still further includes a chelant. The chelant is present in an amount of at least 1 ppm by weight of the rinse aid composition.

Low Foaming Nonionic Surfactant

The nonionic surfactants useful in the acidic rinse aid dispersion may be any known low foaming nonionic surfactant used in machine dishwashing applications. Typical suitable nonionic surfactants include the following commercially available materials: Triton R™ CF-10 (an alkylaryl polyether) and Triton DF-16 (a modified polyalkoxylated alcohol) manufactured by Rohm and Haas Company; Plurafac LF404™, Plurafac LF400™ (mixed linear alcohol alkoxylates), and Pluronic R™ L-62 (a polyoxyethylene-polyoxypropylene block copolymer), all manufactured by BASF Wyandotte Corporation, and BASF RA30 surfactant, manufactured by BASF Corporation. The rinse aid formulation of the invention may contain one or a mixture of such low foaming nonionic surfactants.

Essentially any nonionic surfactants useful for detersive purposes can be included in the rinse aid compositions. Exemplary, non-limiting classes of useful nonionic surfactants are listed below.

(i) Nonionic polyhydroxy Fatty acid amide Surfactant

Polyhydroxy fatty acid amides suitable for use herein are those having the structural formula $R_2CONR_1Z$ wherein: $R_1$ is H, $C_1$–$C_4$ hydrocarbyl, 2-hydroxy ethyl, 2-hydroxy propyl, or a mixture thereof, preferable $C_1$–$C_4$ alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

(ii) Nonionic Condensates of alkyl phenols

The polyethylene, polypropylene, and polybutylene oxide condensates of alkyl phenols are suitable for use herein. In general, the polyethylene oxide condensates are preferred. These compounds include the condensation products of alkyl phenols having an alkyl group containing from about 6 to about 18 carbon atoms in either a straight chain or branched chain configuration with the alkylene oxide.

(iii) Nonionic ethoxylated Alcohol Surfactant

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 10 moles of ethylene oxide per mole of alcohol.

(iv) Nonionic ethoxylated/propoxylated Fatty Alcohol Surfactant

The ethoxylated $C_6$–$C_{18}$ fatty alcohols and $C_6$–$C_{18}$ mixed ethoxylated/propoxylated fatty alcohols are highly preferred surfactants for use herein, particularly where water soluble. Preferably the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

(v) Nonionic EO/PO Condensates with propylene glycol

The condensation products of ethylene oxide with a hydrophobic base formed by the condensation of propylene oxide with propylene glycol are suitable for use herein. The hydrophobic portion of these compounds preferably has a molecular weight of from about 1500 to about 1800 and exhibits water insolubility. Examples of compounds of this type include certain of the commercially-available Pluronic™. surfactants, marketed by BASF.

(vi) Nonionic EO Condensation Products with propylene oxide/ethylene diamine Adducts The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from about 2500 to about 3000. Examples of this type of nonionic surfactant include certain of the commercially available Tetronic™ compounds, marketed by BASF.

(vii) Nonionic alkylpolysaccharide Surfactant

Suitable alkylpolysaccharides for use herein are disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

The preferred alkylpolyglycosides have the formula $$R^2\,O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3, preferably from about 1.3 to about 3, most preferably from about 1.3 to about 2.7. The glycosyl is preferably derived from glucose.

(viii) Nonionic Fatty acid amide Surfactant

Fatty acid amide surfactants suitable for use herein are those having the formula:

$$R^6-\overset{\overset{\displaystyle O}{\|}}{C}-N(R^7)_2$$

wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and $—(C_2H_4O)_xH$, where x is in the range of from 1 to 3.

The hydrotrope useful in the present rinse aid dispersion is selected from the group consisting of sodium cumene sulfonate, sodium xylene sulfonate, sodium toluenesulfonate, dioctyl sodium sulfosuccinate, alkyl naphthalene sulfonate and dihexyl sodium sulfosuccinate. Preferably, the hydrotrope is sodium cumene sulfonate.

Polyacrylate polymer

The low molecular weight polyacrylate polymer useful in the present acidic rinse aid dispersion is selected from the group consisting of polyacrylate homopolymer, polyacrylate copolymer, polyacrylate terpolymer, and mixtures thereof. Preferably, the polyacrylate polymer is a partially neutralized or non-neutralized polyacrylate polymer having a pH in a range of from about 2.0 to about 4.0. In the preferred embodiment, the polyacrylate polymer is desirably at least about 75% non-neutralized. Alternatively, the polyacrylate polymer is non-neutralized. Still alternatively, a neutralized polyacrylate polymer, which is more than 25% neutralized may also be used, but an acid must be added in an amount sufficient to bring the pH value of the resultant rinse aid dispersion within a range of from about 2 to about 6.

Typically the polyacrylate polymer is a homopolymer of acrylic or methacrylic acid, or a copolymer formed from at least about 50 weight percent acrylic acid. The polyacrylate polymer is a low molecular weight polymer or its alkali metal or ammonium salt, having a weight average molecular weight ranging from about 1,000 to about 40,000.

Acid

When adding an acid to the rinse aid dispersion, any acid may be used although organic acids are more desirable and the preferred organic acid is citric acid.

It has been discovered that even in the absence of a compatibilizing high molecular weight polymer, but with the addition of a hydrotrope and in acidic conditions, the stable rinse aid dispersion does not phase separate upon storage for a reasonable time or under actual use conditions and permits each component to effectively reduce spotting and filming and improve sheeting action without interfering with the foaming and defoaming action of the surfactant.

In the preferred embodiment, the rinse aid formulation of the invention is an aqueous dispersion at a pH of from about 2 to about 6. Preferably, the pH ranges from about 3 to about 5.

The rinse aid dispersion of the present invention is preferably prepared by stirring the desired amount of the surfactant into an aqueous solution of the low molecular weight non-neutralized or only partially neutralized (no more than 25% neutralized) polyacrylic acid followed by the gradual addition of the hydrotrope and if necessary, citric acid to bring the dispersion to within the desired pH range.

The formulation may also contain other additives including sequestants such as NTA, EDTA, or sodium citrate and water miscible solvents such as ethanol, isopropanol and propylene glycol. Ethanol is the preferred solvent, present desirably in a range of from about 0.1% to about 10% by weight of the rinse aid dispersion and preferably in a range of from about 2% to about 8% by weight.

Hydrotrope

In the preferred embodiment, the hydrotrope is selected from the group consisting of sodium cumene sulfonate, sodium xylene sulfonate, sodium toluenesulfonate, dioctyl sodium sulfosuccinate, alkyl naphthalene sulfonate and dihexyl sodium sulfosuccinate. Preferably, the hydrotrope is sodium cumene sulfonate, and the partially-neutralized polyacrylate polymer is a polyacrylate copolymer which is about 20% neutralized. In the preferred embodiment, the stable aqueous rinse aid dispersion is essentially free of a high molecular weight compatibilizing polymer and is also free of an additional nonionic surfactant having a cloud point of at least 70 degrees C.

The following examples are intended to illustrate the invention.

EXAMPLE 1

A rinse aid dispersion according to the present invention is made as follows, from the following composition, by weight percent:

| | |
|---|---|
| Low foam nonionic surfactant | 20.0% |
| Sodium cumene sulfonate hydrotrope | 7.0% |
| Polyacrylate copolymer (20% neutralized) | 4.5% |
| Ethanol | 6.0% |
| Chelant (DTPA) | 0.015% |
| Liquitant Patent Blue | 0.25% |
| Water | 62.235% |

This dye has ambient and UV light radiation stability and its color is unchanged after exposure to UV radiation for 1–2 days.

EXAMPLE 2

Another rinse aid dispersion according to the present invention is made as follows, from the following composition, by weight percent:

| | |
|---|---|
| Low foam nonionic surfactant | 35.0% |
| Sodium cumene sulfonate hydrotrope | 4.0% |
| Polyacrylate copolymer (20% neutralized) | 4.0% |
| Citric acid | 1.6% |
| Ethanol | 6.0% |
| Chelant (polyphosphonate) | 0.015% |
| FD&C Blue #1 | 0.25% |
| Water | 49.135% |

This dye has ambient and UV light radiation stability and its color is unchanged after exposure to UV radiation for 1–2 days.

EXAMPLE 3

Another rinse aid dispersion according to the present invention is made as follows, from the following composition, by weight percent:

| | |
|---|---|
| Low foam nonionic surfactant | 12.0% |
| Sodium cumene sulfonate hydrotrope | 4.0% |
| Polyacrylate copolymer (20% neutralized) | 1.0% |
| Citric acid | 1.6% |
| Ethanol | 5.0% |
| Chelant (polyphosphonate) | 0.015% |
| FD&C Blue #1 | 0.25% |
| Water | 76.135% |

This dye has ambient and UV light radiation stability and its color is unchanged after exposure to UV radiation for 1–2 days.

The above rinse aid formulations are prepared by the following procedure: appropriate amounts of: a low foaming nonionic surfactant (Plurafac LF 404™), a 45% active sodium cumene sulfonate hydrotrope (45% active SCS), a 50% active polyacrylate copolymer (Acusol 480™, made by Rohm & Haas), a 50% active citric acid, ethanol and deionized water are added to a beaker and stirred sequentially. Also added is a chelant in an amount of 0.015 weight % (150 ppm by weight) and a color dye as indicated. The resulting mixture obtained is a blue or green colored, single-phase acidic dispersion and is stable, with no phase separation occurring after the resulting mixture is kept undisturbed in a closed container for a period of 2 weeks at a temperature of 50 degrees C. Further, the resulting mixture exhibits no more than about a 30% dye discoloration when exposed to ambient light for 6 months, and no more than about a 30% dye discoloration when exposed to UV light for 2 days.

Accordingly, having thus described the invention in detail, it will be obvious to those skilled in the art that various changes may be made without departing from the scope of the invention and the invention is not to be considered limited to what is described in the specification.

What is claimed is:

1. A method for improving stability of a dye used in a colored aqueous acidic rinse aid composition to ambient and ultra-violet light radiation, comprising: adding a chelant to said acidic rinse aid composition, said chelant being present in the range of at least 1 ppm to about 150 ppm by weight of said rinse aid composition, and said dye being blue.

2. A method according to claim 1, wherein said chelant is present in the range of at least 50 ppm to about 150 ppm by weight of said rinse aid composition.

3. A method according to claim 1, wherein said chelant is selected from the group consisting of amino carboxylates, amino phophonates, polyfunctionally-substituted aromatic chelants, and mixtures thereof.

4. A method according to claim 1, wherein said chelant is selected from the group consisting of ethylene diamine tetra acetic acid carboxylate, diethylene triamine penta acetic acid carboxylate, and mixtures thereof.

5. A method according to claim 1, wherein said chelant is ethylene triamine penta phosphoric acid.

6. A method according to claim 1, wherein said dye is selected from the group consisting of copper phthalocyanine dyestuff, FD&C #1 color, polymeric colorants, and mixtures thereof.

7. A method according to claim 1, wherein said dye is selected from the group consisting of copper phthalocyanine dyestuff, FD&C #1 color, polymeric colorants, and mixtures thereof, and said chelant is selected from the group consisting of amino carboxylates, amino phosphonates, polyfunctionally-substituted aromatic chelants, and mixtures thereof.

8. A method according to claim 7, wherein said chelant is present in the rang of at least 50 ppm to about 150 ppm by weight of said rinse aid composition.

9. A colored acidic rinse aid composition exhibiting improved stability of a dye used therein to ambient and ultra-violet light radiation, comprising:

(a) a low foaming nonionic surfactant present in a range of from about 2% to about 80% by weight of said rinse aid composition;

(b) a hydrotrope present in a range of from about 0.5% to about 20% by weight of said rinse aid composition;

(c) a polyacrylate polymer present in a range of from about 0.1% to about 15% by weight of said rinse aid composition, said polymer having a weight average molecular weight in a range of from about 1000 to about 50,000; and (d) a chelant, said chelant being present in a range of at least 1 ppm to about 150 ppm by weight of said rinse aid composition;

wherein said dye is blue.

10. An acidic rinse aid composition according to claim 9, wherein said rinse aid has a pH in a range of from about 2 to about 7.

11. An acidic rinse aid composition according to claim 9, including an acid present in a range of from about 0.1% to about 20% by weight of said rinse aid composition.

12. An acidic rinse aid composition according to claim 9, wherein said chelant is selected from the group consisting of amino carboxylates, amino phophonates, polyfunctionally-substituted aromatic chelants, and mixtures thereof.

13. An acidic rinse aid composition according claim 12, wherein said dye is selected from the group consisting of copper phthalocyanine dyestuff FD&C #1 color, polymeric colorants, and mixtures thereof.

14. An acidic rinse aid composition according to claim 13 wherein said chelant is present in the range of at least 50 ppm to about 150 ppm by weight of said rinse aid composition.

15. An acidic rinse aid composition according to claim 14 having a pH in the range of from about 3 to 5.

* * * * *